United States Patent [19]

Compen

[11] 4,230,966

[45] Oct. 28, 1980

[54] METAL STRIP ATTACHED TO HIGH VOLTAGE CONTACT WITH GETTER AT ONE END AND CONTACT TO SHIELD CONE AT THE OTHER

[75] Inventor: Johannes M. A. A. Compen, Eindhoven, Netherlands

[73] Assignee: U.S. Philips Corporation, New York, N.Y.

[21] Appl. No.: 953,330

[22] Filed: Oct. 20, 1978

[30] Foreign Application Priority Data

Nov. 18, 1977 [NL] Netherlands ..... 7712707

[51] Int. Cl.[3] ..... H01J 29/07; H01J 29/84

[52] U.S. Cl. ..... 313/481; 313/402; 313/477 HC

[58] Field of Search ..... 313/481, 482, 402, 407

[56] References Cited

U.S. PATENT DOCUMENTS

| | | | |
|---|---|---|---|
| 3,821,583 | 6/1974 | Steiner | 313/407 |
| 4,065,693 | 12/1977 | Gijrath | 313/407 |

FOREIGN PATENT DOCUMENTS

| | | | |
|---|---|---|---|
| 1226728 | 3/1971 | United Kingdom | 313/481 |

*Primary Examiner*—Robert Segal

*Attorney, Agent, or Firm*—Simon L. Cohen

[57] ABSTRACT

In a color television display tube having an internal resistive layer the getter is connected to the high voltage contact by means of a metal connection strip. In order to reduce the radio interference radiation level of the tube the connection strip has a metal contact spring which contacts the internal magnetic screening cone of the tube.

2 Claims, 2 Drawing Figures

Figure 1:
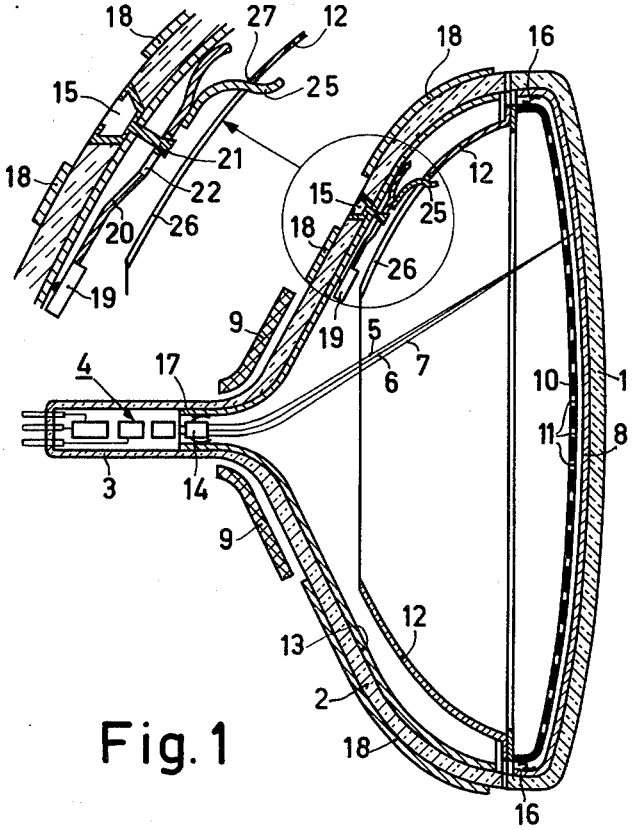

METAL STRIP ATTACHED TO HIGH VOLTAGE CONTACT WITH GETTER AT ONE END AND CONTACT TO SHIELD CONE AT THE OTHER

The invention relates to a colour television display tube.

Generally a display tube comprises an envelope having a neck, a cone and a window portion, an electrode system which is provided in the neck for generating at least two electron beams, a display screen provided internally on the window portion, a colour selection electrode situated at a short distance from the display screen, an electric resistive layer provided on an internal wall portion of the envelope situated between the electrode system and the display screen, a high voltage contact provided in the envelope between the electrode system and the display screen and being connected electrically with the resistive layer, a getter which is attached to the high voltage contact by means of a resilient metal strip, and a magnetic screening cone extending within the cone and being connected electrically to the colour selection electrode.

Such a display tube is disclosed in British Patent Specification No. 1,226,728. The resistive layer serves to restrict the detrimental results of a possible electric flashover in the tube on the electronic circuit of the television receiver in which the tube is mounted. Such flashovers occur mainly between adjacent electrodes of the electrode system situated in the tube neck which are operated at very different potentials. The capacitor formed by the conductive inner and outer coatings of the cone and serves as a smoothing capacitor for the high voltage of the tube discharges. The internal resistive layer restricts the current strength occurring in such a discharge as well as the speed at which the current strength reaches its maximum value. The possibility of damage to the electronic circuit of the receiver via inductive or capacitive couplings is thus reduced.

Although good results can be obtained with such a resistive layer with respect to the safety of the electronic circuit of the television receiver, the use of said layer proves to be not quite without problems in another respect. Problems occur notably which are related to the fact that an operating television receiver may be a source of interference for a radio receiver placed in the proximity thereof and tuned to a transmitter in the long or medium waveband. Such interference originates largely from the video signal. During operation of the display tube a portion of the electron beams modulated according to the video signal impinges upon the colour selection electrode which is situated at a short distance in front of the display screen. The electric potential of the colour selection electrode thus fluctuates in accordance with the amplitude of the video signal. These fluctuations cause the interference mentioned above.

It is the object of the invention to provide a colour television display tube having an internal resistive layer in which measures are taken to reduce the above-mentioned interference.

For that purpose, according to the invention, a colour television display tube comprising an envelope having a neck, a cone and a window portion, an electrode system provided in the neck to generate at least two electron beams, a display screen provided internally on the window portion, a colour selection electrode which is situated at a short distance from the display screen, an electric resistive layer provided on an internal wall part of the envelope situated between the electrode system and the display screen, a high voltage contact provided in the envelope between the electrode system and the display screen and being connected electrically with the resistive layer, a getter which is attached to the high voltage contact by means of a resilient metal strip, and a magnetic screening cone extending within the cone and being connected electrically to the colour selection electrode, is characterized in that the metal connection strip of the getter comprises a metal contact spring which is in contact with the magnetic screening cone.

It is to be noted that U.S. Pat. No. 3,543,072 discloses a colour television display tube in which a metal contact spring connected to the high voltage contact produces an electric connection with the metal frame of the colour selection electrode. In this known construction the pressure point of the contact spring is moved from the conductive inner coating to the frame of the colour selection electrode so as to avoid damage to the conductive inner coating as a result of mechanical vibration of the contact spring. The conductive inner coating of said known tube, however, does not consist of a resistive layer and the problems for which the present invention provides a solution do not play a part at all. The U.S. Patent furthermore gives no indication whatsoever as to the location of the getter in the display tube. In display tubes to which the present invention relates, the resistive layer may have a resistance of at least 100 Ohm per square. Accordingly the position of the getter in the display tube is important. Although for practical reasons the whole inner wall of the tube between the electrode system and the display screen is covered with a resistive layer, the portion of the resistive layer which is effective for the end in view is mainly restricted to the part thereof extending in the tube neck and over the transition neck-cone. Therefore, this portion of the resistive layer may not be covered with the gettering material evaporated from the getter because the gettering material would shortcircuit the resistive layer. For this reason the getter is connected to the high voltage contact by means of the metal connection strip. The invention uses said connection construction advantageously by also providing the connection strip of the getter with a metal contact spring which contacts the metal magnetic screening cone.

The invention is based on the recognition that the interference caused by the tube decreases with decrease of the electric resistance in the connection path from the colour selection electrode to the resistive layer. All this is associated with the fact that the capacitor formed by the resistive layer and the conductive coating on the outer wall of the cone acts as a filter for the interference caused by the tube. The effective filtering action of this capacitor which is grounded via the coating on the outer wall of the cone to the chassis of the receiver, increases because the colour selection electrode is connected more direct, that is to say lower-ohmic, to said capacitor. The filtering action of the capacitor, furthermore, improves as the electric conductivity of the inner and outer coating of the cone increases. In this connection the position of the getter near the high voltage contact is particularly favourable. The gettering material evaporated from the getter is deposited mainly over an area in the proximity of the high voltage contact on the resistive layer and short-circuits the resistive layer at that area. A shortcircuit at that area of the resistive layer does not reduce the action of the resistive layer as a current limiter in the case of a possible electric flash-over in the tube, since, as already said, the portion of the resistive layer effective for that purpose is restricted to the neck and the transition neck-cone.

The connection of the getter to the high voltage contact in combination with the contact spring pressing against the magnetic screening cone has practical advantages not only from the constructive point of view but has also proved to be favourable in addition in particular to reduce the radio interference radiation level of the display tube.

According to one embodiment of the invention the magnetic screening cone has a slot-like recess and the metal contact spring presses against the edge of the recess. In this manner not only a good electric contact of the spring to the screening cone is obtained but a locking of the connection strip of the getter against a possible rotation around the high voltage contact is also realized.

Figure 2:
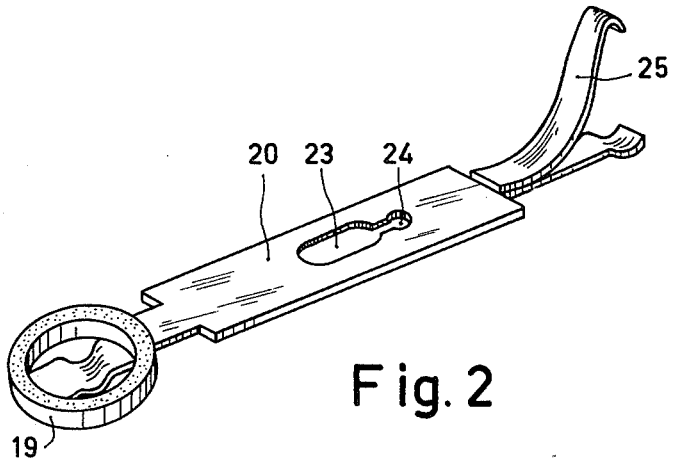

The invention will be described in greater detail with reference to the accompanying drawings, in which FIG. 1 is a diagrammatic sectional view of a colour television display tube in accordance with the invention, and FIG. 2 shows an embodiment of a getter comprising a connection strip and a metal contact spring as used in the display tube shown in FIG. 1.

The tube shown in FIG. 1 comprises a glass envelope consisting of a display window 1, a cone 2 and a neck 3. Electrode system 4 for generating three electron beams 5, 6 and 7 is positioned in the neck 3. The electron beams are generated in one plane, in this case normal to the plane of the drawing, and are directed on a display screen 8 which is provided internally on the display window 1 and comprises a large number of phosphor strips luminescing in red, green blue and whose longitudinal direction is parallel to the plane of the drawing. On their way to the display screen 8 the electron beams 5, 6 and 7 are deflected over the display screen 8 by means of a number of deflection coils 9 placed coaxially around the tube axis and pass through a colour selection electrode 10 consisting of a metal plate having elongate apertures 11 whose longitudinal direction is also parallel to the plane of the drawing. The three electron beams 5, 6 and 7 pass through the apertures 11 at a small angle with each other and consequently each impinges only on phosphor strips of one colour. The tube further comprises an internal magnetic screen cone 12 which screens the electron beams 5, 6 and 7 from the earth's magnetic field. The inner wall of the tube is covered with an approximately 10 μm thick resistive layer 13 containing approximately 6 parts by weight of iron oxide ($Fe_2O_3$), 1 part by weight of graphite and 2.5 parts by weight of potassium silicate. The layer 13 is connected to a high voltage contact 15 provided in the tube wall. The colour selection electrode 10 is connected to the display screen 8 via contact springs 16, while the last electrode 14 of the electrode system 4 is connected to the resistive layer 13 via contact springs 17.

The outer wall of the cone 2 is covered with a readily conductive coating 18 which consists mainly of graphite. The resistive layer 13 and the coating 18 form a capacitor, with the glass of the cone 2 therebetween as a dielectric, which serves as a smoothing capacitor for the high voltage. As is known, after evacuating the tube, a layer of gettering material of, for example, barium, strontium, calcium or magnesium is deposited in the tube so as to getter residual gases remaining in the tube after it is sealed. A getter 19 from which the gettering material is released by inductive heating is detachably connected to the high voltage contact 15 by means of a metal connection strip 20. As shown in the enlarged detail of FIG. 1, the high voltage contact 15 is provided for that purpose with a conically widening pin 21 cooperating with a slotted hole 22 in the strip 20. As shown in FIG. 2 the slotted hole 22 has a wide aperture 23 and a narrow aperture 24. For the connection the wide aperture 23 is positioned over the pin 21 and the pin 21 is then inserted in the aperture 24 by moving the strip 20. Due to the resilience of the slightly pre-bent strip 20, the latter presses, at the area of the aperture 24, against the conically widening pin 21 securing the strip 20 to the pin 21. Instead of a detachable connection, the strip 20 may alternatively be secured to the high voltage contact permanently, for example by spot-welding. A metal contact spring 25 is welded to the connection strip 20. The contact spring 25 presses against the edge 27 of a slot-like recess 26 provided in the magnetic screening cone 12. In this manner a direct electric connection between the magnetic screening cone 12 connected electrically to the colour selection electrode 10 and the high voltage contact 15 is produced. This construction also prevents the possibility of any rotation of the connection strip 20 about the pin 21. With the construction described a reduction of the radio interference radiation level by at least 10 dB is realized as compared with a tube in which the magnetic screening cone electrically contacts the resistive layer in the usual manner by means of contact springs spot-welded thereto.

I claim:

1. A colour television display tube comprising an envelope having a neck, a cone portion and a window portion, an electrode system positioned in said neck for generating at least two electron beams, a display screen provided on the interior surface of said window portion, a colour selection electrode positioned in said envelope adjacent said display screen, a magnetic screening cone secured to said color selection electrode and extending within the cone portion towards said neck, said screening cone being electrically connected to said colour selection electrode, a resistive layer provided on an internal wall portion of the envelope between said electrode system and said display screen, a high voltage contact extending through said envelope at a position between said electrode system and said display screen and being connected electrically to said resistive layer, a getter and a metal strip having one end affixed to said getter for securing said getter to said high voltage contact, said strip being attached to said high voltage contact and having on the other end a metal spring in electrical contact with said screening cone to thereby electrically connect said screening cone and said colour selection electrode to said high voltage contact and said resistive layer.

2. The display tube according to claim 4 wherein said magnetic screening cone has a recess and said contact spring engages said recess to prevent said strip from rotating about the longitudinal axis thereof.

* * * * *

UNITED STATES PATENT AND TRADEMARK OFFICE

CERTIFICATE OF CORRECTION

PATENT NO. : 4,230,966

DATED : October 28, 1980

INVENTOR(S) : JOHANNES M.A.A. COMPEN

It is certified that error appears in the above—identified patent and that said Letters Patent is hereby corrected as shown below:

Col. 4, Claim 2. Change "4" to --1--

Signed and Sealed this

*Eighth* Day of *February 1983*

[SEAL]

*Attest:*

GERALD J. MOSSINGHOFF

*Attesting Officer*

*Commissioner of Patents and Trademarks*